United States Patent [19]

Rehrig et al.

[11] Patent Number: 4,671,411

[45] Date of Patent: Jun. 9, 1987

[54] NESTABLE OPEN CASE

[75] Inventors: James B. Rehrig, Rancho Palos Verde; John Hagan, Fountain Valley, both of Calif.

[73] Assignee: Rehrig Pacific Company, Los Angeles, Calif.

[21] Appl. No.: 815,926

[22] Filed: Jan. 3, 1986

[51] Int. Cl.[4] ..... B65D 21/04; B65D 21/02

[52] U.S. Cl. ..... 206/505; 206/510; 206/511; 211/126; 294/169

[58] Field of Search ..... 206/505, 506, 510, 511; 294/169, 170; 211/126

[56] References Cited

U.S. PATENT DOCUMENTS

| | | | |
|---|---|---|---|
| 2,736,453 | 2/1956 | Russell | 206/510 |
| 2,923,432 | 2/1960 | Stanley | 206/510 |
| 3,037,659 | 6/1962 | Fredrich | 206/513 |
| 3,403,788 | 10/1968 | Kreeger . | |
| 3,622,037 | 11/1971 | Gildart | 220/73 |
| 3,887,073 | 6/1975 | Wilson . | |
| 3,997,074 | 12/1976 | Sheat | 220/71 |
| 4,106,625 | 8/1978 | Carroll et al. . | |
| 4,270,678 | 6/1981 | Drader | 206/506 |
| 4,441,615 | 4/1984 | Goodrich | 206/505 |

FOREIGN PATENT DOCUMENTS

| | | | |
|---|---|---|---|
| 1059418 | 2/1967 | United Kingdom | 206/510 |

*Primary Examiner*—George E. Lowrance

*Attorney, Agent, or Firm*—Banner, Birch, McKie & Beckett

[57] ABSTRACT

A molded plastic and metal case is provided which is designed to be stackable with other cases of the same construction to provide a sturdy display of the products contained therein and which is also nestable with other like cases to provide compact storage of empty cases. The display case is formed primarily of molded plastic and includes two upstanding metal frames on either side which form handles for carrying the case. Along the inside bottom of the case is a metal ring which is welded to the upstanding metal frames. The upper portion of each handle forms a stacking ledge which is received within a channel positioned adjacent and parallel to the side edges along the underside of each case, thus allowing the cases to be securely stacked. Adjacent each channel is a parallel slot which extends through the underside of each case and is used for nesting empty cases. The slot is designed to receive the frames of the next two lower cases thereby permitting a nesting ratio of 3:1 or greater.

16 Claims, 7 Drawing Figures

FIG. 2
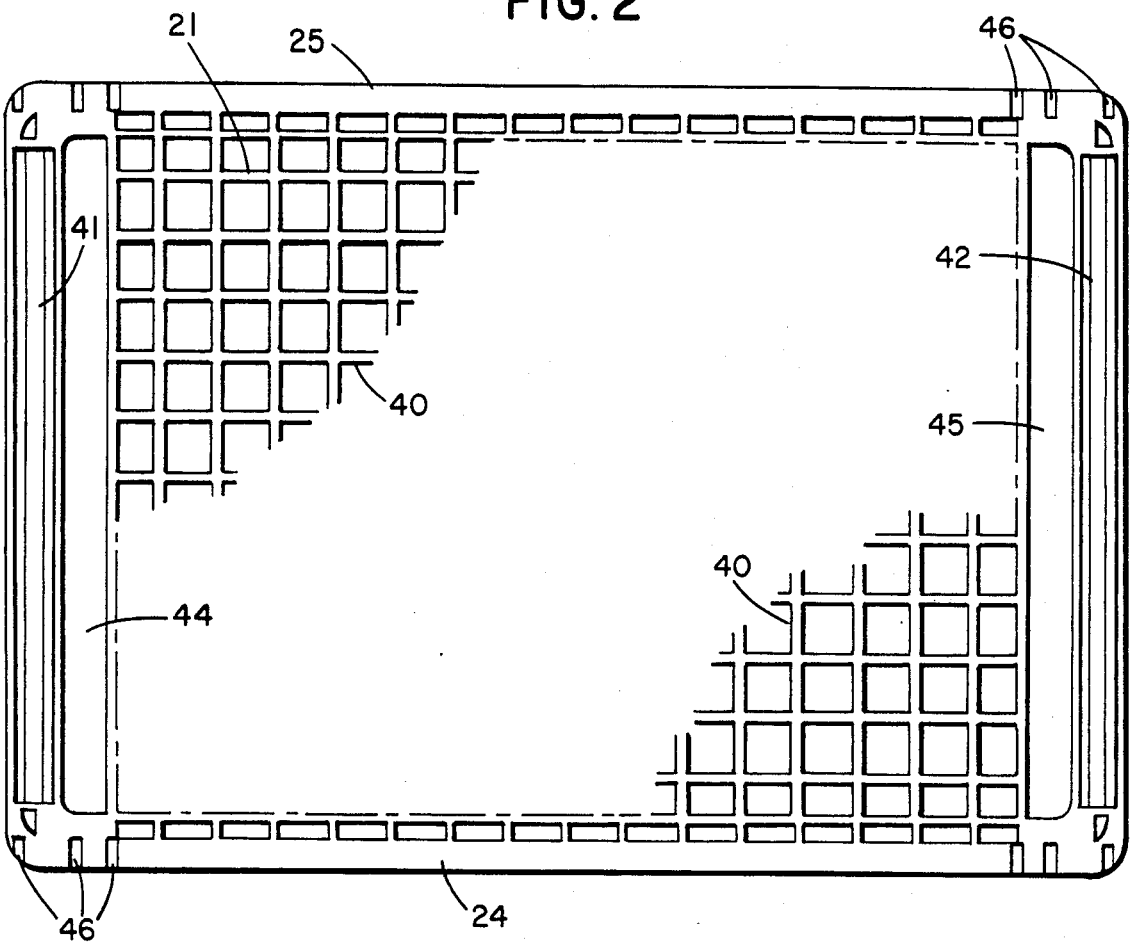
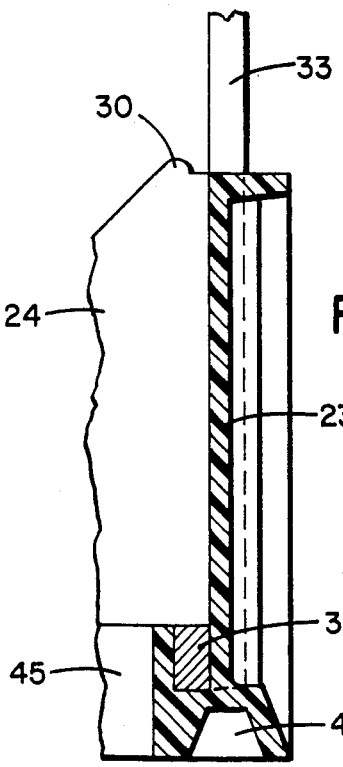
FIG. 3
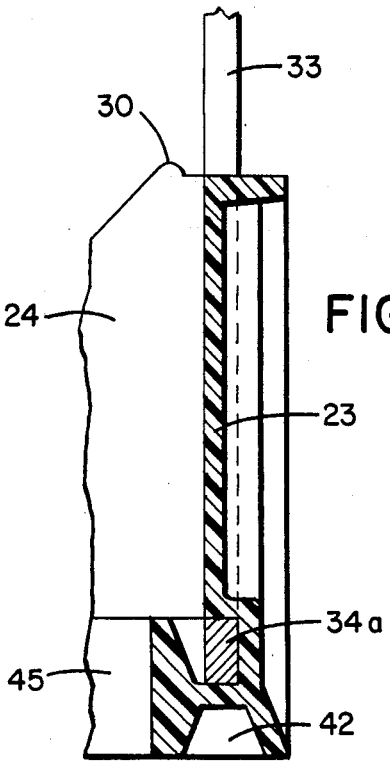
FIG. 4

NESTABLE OPEN CASE

BACKGROUND OF THE INVENTION

This invention relates to a stacking and nesting display case.

Cases of various kinds are widely used in industry to transport and display various types of commodities, for example, foodstuffs such as dairy products. Cases of the nesting and stacking type have been utilized because of their ability to nest when empty with other cases of the same construction in a compact group and also because of their ability to be stacked when filled with material one upon the other such that the material in the case can be transported and displayed for sale without being crushed.

Typical nestable stackable cases currently in use will either stack or nest depending upon the orientation of each case with respect to the cases directly above and below. For example, when all the cases are oriented similarly they will stack, but when every other case is rotated by 90° or 180°, the cases will nest. This causes some difficulty for those utilizing these prior art cases since each case must be analyzed and rotated properly for stacking or nesting.

Most cases in use now are made exclusively of plastic materials due to the economic advantages of inexpensive molded plastic. Unfortunately, durability and strength have been sacrificed with the continued preference for plastic cases over metal cases. The cases tend to warp or bend and frequently break. This is especially true due to the fact that when stacks of filled cases are placed on pallets the lower case frequently overhangs the pallet causing an unusually large amount of pressure to be placed on a small portion of the case.

SUMMARY OF THE INVENTION

It is an essential object of this invention to provide an improved nestable open case which can be nested when empty with other cases of the same construction in a compact group and can be stacked one upon the other to provide a display case for the products contained therein.

Another object of the invention is to provide a nestable open case which can stack with a similarly oriented lower case of identical construction or nest with a similarly oriented lower case of identical construction.

It is also an object of the invention to provide a nestable open case with upstanding frames used for stacking and nesting and which also form handles for carrying the case.

Another object of the invention is to provide a nestable open case containing a plurality of slots passing through the bottom of the case such that when the cases are nested the upstanding frames of two lower oriented cases can pass through one of the slots in order to provide a compact group.

A further object is to provide a nestable open case containing a plurality of channels in the bottom of a case for receiving the upstanding frames from a lower oriented case when stacking thereby providing a securely stacked display with easy access to the products contained in the cases.

A further object of the invention is to provide a metal reinforced nestable open case that is both economical to make and extremely strong and durable.

The reinforced nestable open case of the present invention is formed by pairs of opposed side walls integrally joined at their adjoining longitudinal edges to define a rectangular box with a slotted bottom closing one end of this box. Two of the opposing side walls are generally higher than the other two with each of the higher walls containing an upstanding frame. A rectangular metal ring fits into a groove that runs along the inside bottom of the case and is welded to the two upstanding frames. At each of the two sides of the slotted bottom that correspond to the two higher side walls there is a slot passing through the bottom that is wide enough to accomodate two of the metal frames when nesting. Paralleling each slot is a channel used to secure the upstanding frame of the case below when stacked.

The features of the present invention which are believed to be novel are described hereinafter with reference to a preferred embodiment of a nestable open case.

BRIEF DESCRIPTION OF THE DRAWINGS

The foregoing objects, as well as others, will become apparent through consideration of the following detailed description of the invention given in connection with the accompanying drawings in which:

FIG. 2 is a bottom plane view of the nestable open case.

FIG. 3 is a sectional view along line 3—3 in FIG. 1 of one embodiment of the invention.

FIG. 4 is a sectional view along line 3—3 of FIG. 1 of a second embodiment of the invention.

DETAILED DESCRIPTION OF A PREFERRED EMBODIMENT

The overall construction for the nestable open case may best be understood from FIGS. 1–5 and the following detailed description. All of the cases shown in the various views are of identical construction and throughout the drawings corresponding numbers represent corresponding parts.

Figure 1:
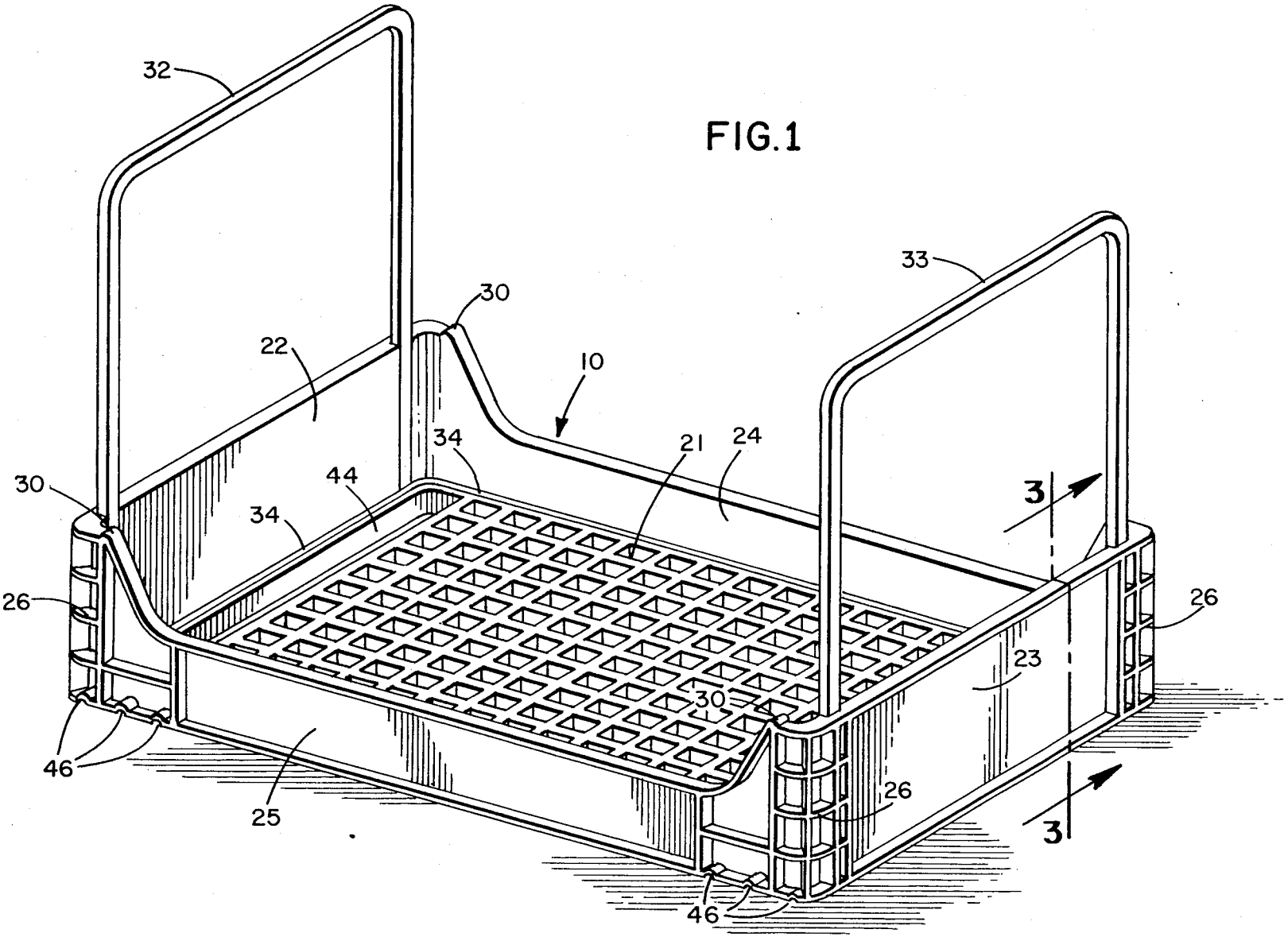
FIG. 1 is a perspective view of a nestable open case constructed in accordance with the present invention.

FIG. 1 shows a perspective view of the case 10 having a rectangular bottom 21 which connects two pairs of opposed side walls. One of said pairs of opposed side walls forms vertical end walls 22 and 23 which are connected at their longitudinal edges to side walls 24 and 25. The side walls 24 and 25 are vertically shorter and horizontally longer than the end walls 22 and 23. At each corner formed by the joining of an end wall and a side wall there is a series of supporting ribs 26. Each corner also includes a projection 30 used to help support an above oriented case when nesting. The projections 30 will fit into one of the grooves 46 when the cases are nested and will thus help to secure the cases. Two upstanding U-shaped metal frames 32 and 33 protrude from each of the end walls 22 and 23. The metal frames are used for stacking and nesting the cases as will be described and can be used as handles for carrying the cases individually.

Along the base of case 10 is a rectangular metal ring 34 to which upstanding frames 32 and 33 are attached. FIG. 3 shows a cross sectional view of case 10 taken along line 3—3 in FIG. 1. Frame 33 is welded onto the side of ring 34 which is inserted into a suitable groove in the plastic case. The edge of the groove contains a series of standard plastic projections (not shown) such that ring 34 will pass into the groove and will be securely held in place. FIG. 4 shows an alternative embodiment whereby the ring 34 fits into a groove along each of the side walls 22 and 23. The upstanding frames would then be welded to the top of ring 34.

Figure 5:
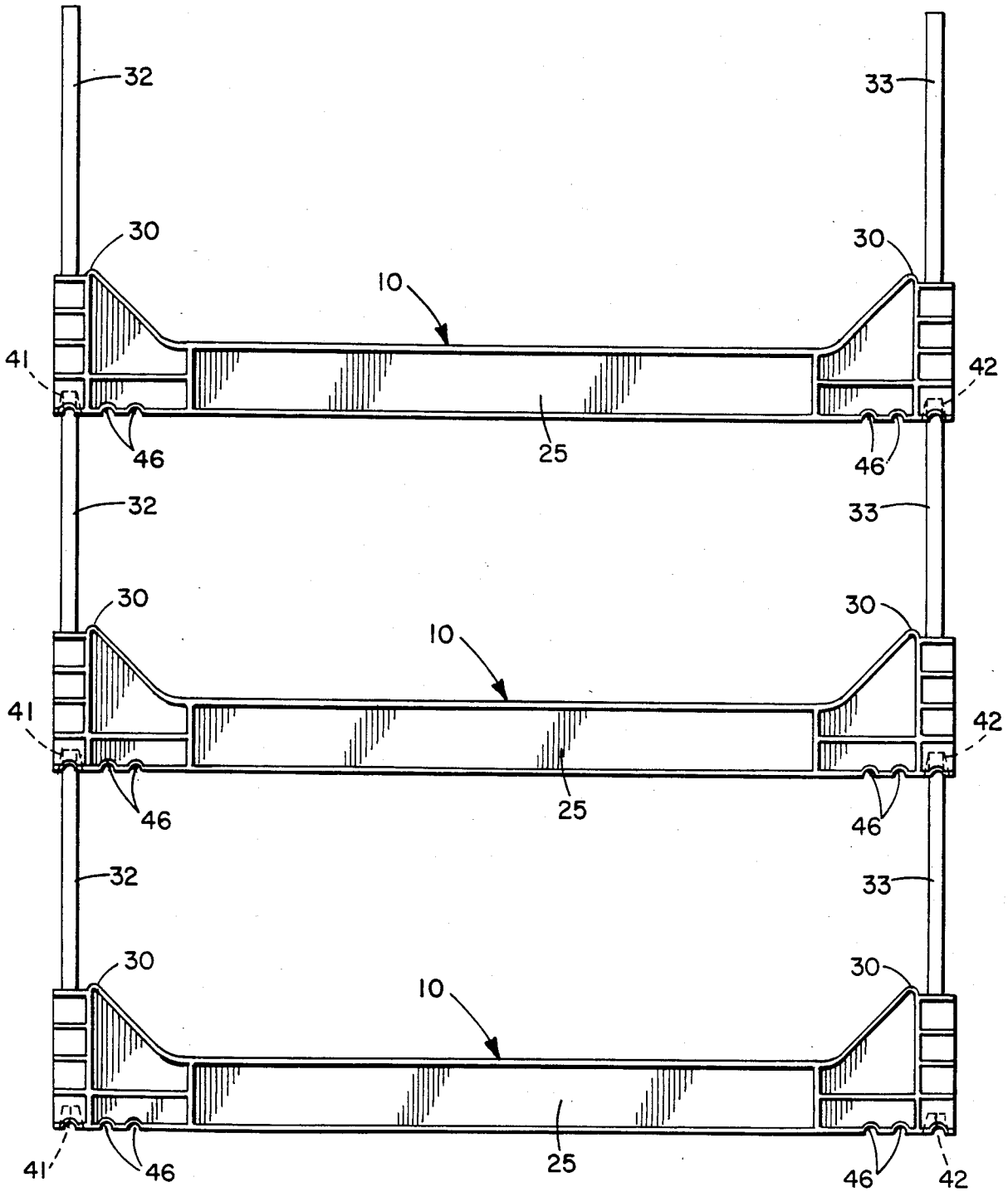
FIG. 5 is a frontal view of three stacked cases.

FIG. 2 shows a planar view of the bottom of the nestable open case. The bottom 21 is composed mainly of supporting ribs 40. Positioned adjacent and parallel to the bottom edges located directly below the end walls 22 and 23 are channels 41 and 42. The upper portion of each metal frame 32 and 33 forms a stacking ledge which fits within the channels 41 and 42, thus allowing the cases to be securely stacked. FIG. 5 shows a frontal view of the cases when stacked in this manner. Note how the upper portions of the frames 32 and 33 fit securely into the channels 41 and 42.

Returning to consideration of the structural details of the nestable open case 10 as shown in FIG. 2, adjacent to each of the channels 41 and 42 is one of parallel slots 44 and 45 which extend through bottom 21 and are used for nesting empty cases. Also depicted in FIG. 2 are grooves 46 used to help secure the cases when nested.

Figure 6:
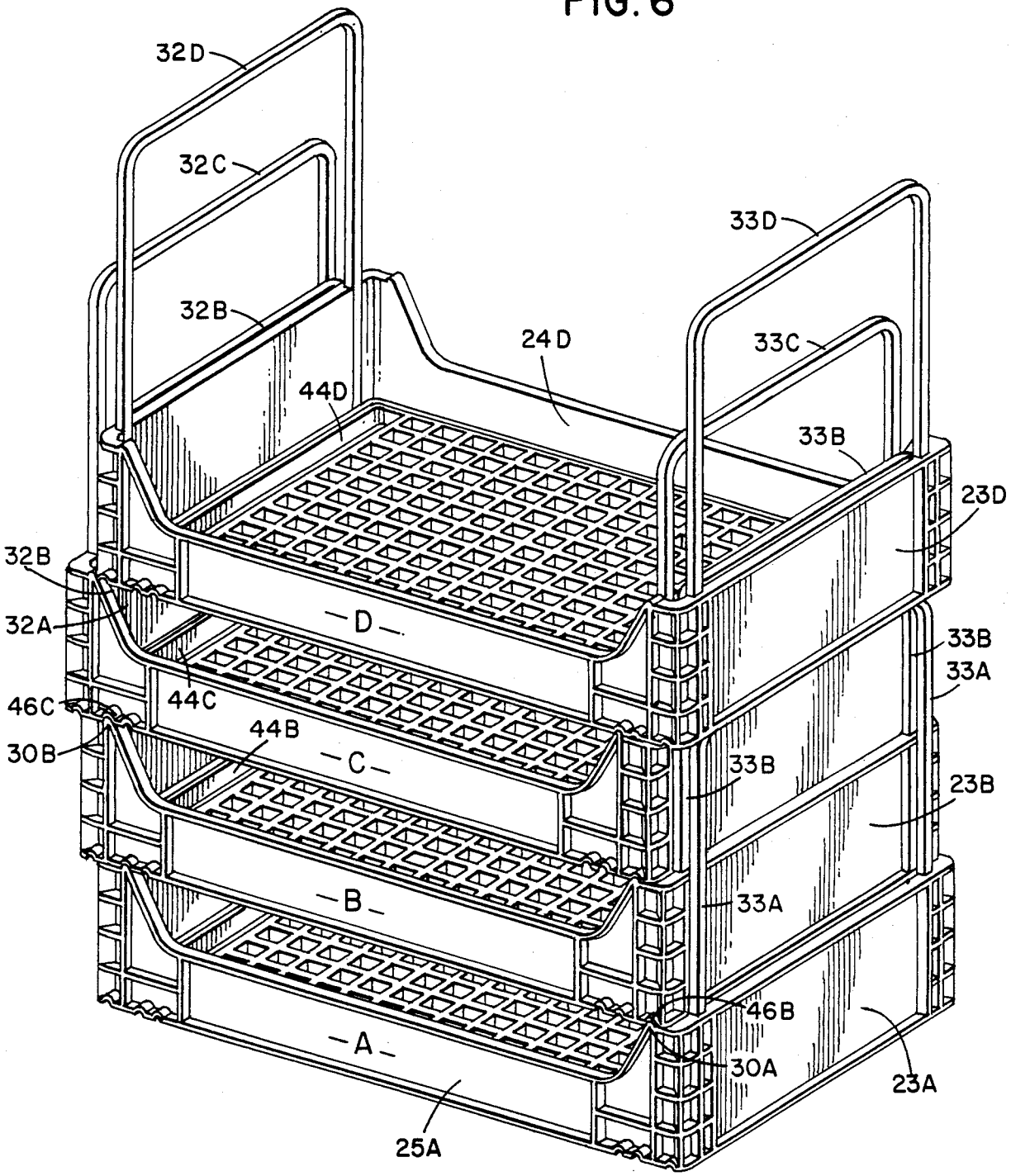
FIG. 6 is a perspective view of four cases in a nested configuration.
Figure 7:
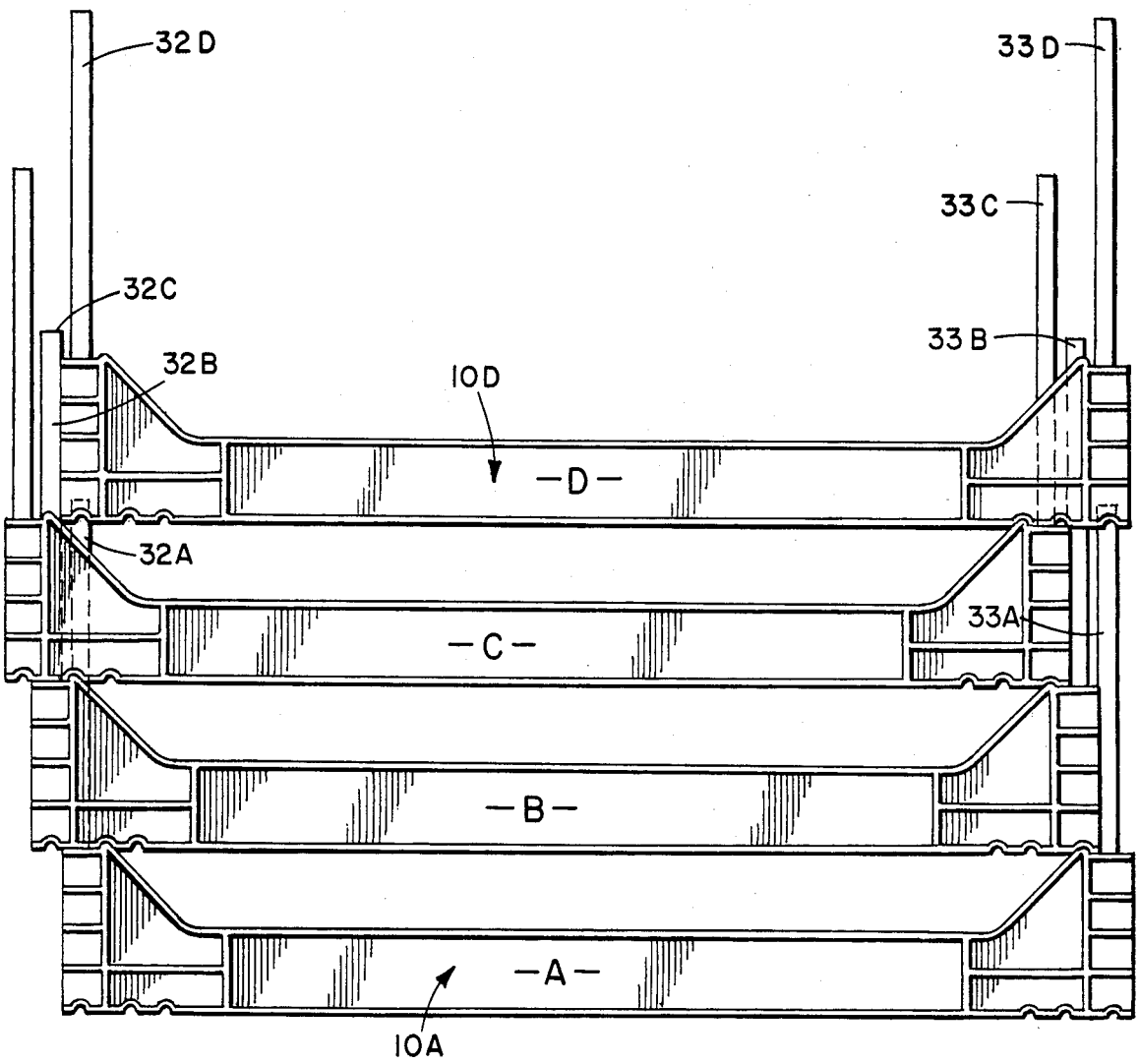
FIG. 7 is a frontal view of four cases in a nested configuration.

FIG. 6 shows a perspective view of four cases nested in accordance with the present invention. For ease of explanation, the four cases have been labelled A, B, C and D, and their corresponding parts have been labelled with both the appropriate number and letter. Case B nests upon case A with frame 32A passing through slot 44B. Frame 33A does not pass through a slot in case B but passes along the outside of wall 23B. At each corner, one of the projections 30A engage a groove 46B to help secure the cases. Case C nests on top of cases A and B with both frames 32A and 32B passing through slot 44C. Each of the projections 30B engage an appropriate groove 46C. Case D nests on top of the other three cases with frames 33B and 33C passing through slot 45D (not shown). The upstanding frames of case A (32A and 33A) fit into the channels on the bottom of case D, the height of the upstanding frame being slightly greater than the height of the side walls. Case D nests with case A in the same manner as if the two cases were stacked. In other words, if cases B and C were not depicted in FIG. 4, cases A and D would be in a stacked configuration. Projections 30C engage appropriate grooves on case D only on the right side. A fifth case, case "E" (not shown), would nest upon case D in the same way that case B nests upon case A. Frame 32D would pass through slot 44E and frame 33C would pass through slot 45E. The nesting of the cases would continue in this manner. FIG. 7 shows a frontal view of the nested cases of FIG. 6. Note how cases A and D are in alignment and are arranged in the same manner as the stacked cases of FIG. 5. Every case will be laterally offset or displaced with respect to an adjacent case. Case A is offset with respect to case B, for example, and case C is offset with respect to cases B and D. If a fifth case were nested, it would be in alignment with case B and would engage case B in the same manner that case D engages case A.

This nesting configuration allows very compact storage of empty trays with the ratio of the height of stacked cases in nesting cases being 3 to 1 or greater. The nesting ratio can be varied depending upon the height of the sides of the cases and the size of the grooves.

The unique design of applicant's invention allows for an extremely strong and durable case. The metal ring and frames prevent the case from bending or warping when stacked with heavy material.

The invention also provides an ideal display case since there is easy access to the products from all four sides. The cases can also be easily shrink wrapped to keep the products contained therein fresh.

It should be noted that in the examples of stacking and nesting shown in FIGS. 5, 6 and 7, all of the cases were oriented in the manner shown in FIG. 1, i.e., with frame 32 on the left and sidewall 25 facing forward. This was done for illustrative purposes only. The cases are actually symetrical, there being no differences between frames 32 and 33 or sidewalls 24 and 25 etc. The cases of the present invention can stack and nest with either orientation unlike prior art cases which will stack or nest depending upon the orientation of the cases.

It will be understood that the frames 32 and 33 can be made of any material, or combination preferably a metal.

Also, while the case has been shown to be basically rectangular, the exact dimensions will depend upon the dimensions and quantity of the merchandise to be transported and displayed therein. The exact height of the sidewalls 24 and 25 and end walls 22 and 23 can also be varied. It is possible, for example, that all four walls can be of the same height or that the sidewalls can be higher than the end walls.

Whereas a preferred embodiment has been illustrated and described as illustrative of the invention herein, it is to be understood that the nestable open case of the invention herein shown and described must be taken only as a preferred representation of the invention. Accordingly, various changes and modifications in the arrangement of the components, parts, elements, etc. may be resorted to without departing from the disclosure of the invention or the scope of the appended claims.

What is claimed is:

1. A case capable of being stacked or nested with cases of similar construction comprising:

a pair of opposed side walls;

a pair of opposed end walls integrally joined at their longitudinal edges with said side walls;

a bottom joined to the bottom of each of said side walls and said end walls to define a box with an open top;

an upstanding frame extending upwardly from each said side wall, said frame having an upper portion;

an elongated slot extending completely through said bottom, said slot being adjacent and substantially parallel to said side walls, said slot having a length and width sufficient to permit passage of an upstanding frame from each of two lower oriented cases, when in a nested configuration.

2. A case as recited in claim 1 wherein in a nested configuration one and only one upstanding frame from an adjacent case located beneath said case passes through said slot.

3. A case as recited in claim 2 wherein in a nested configuration one upstanding frame from an adjacent case located beneath said case passes along the outside of one of said side walls.

4. A case as recited in claim 1 wherein said opposed side walls includes at least one projection on the upper portion of each wall and at least one groove on the bottom portion of each wall such that when two or more cases are nested, the projection from one case engages the groove of an adjacent case thus helping to secure the cases.

5. A case as recited in claim 1 further comprising an elongated channel adjacent each of said side walls such that when the cases are in a stacked configuration each channel is adapted to receive an upper portion of the frame of a lower oriented case thus permitting the cases to be securely stacked one upon the other.

6. A case as recited in claim 1 wherein said upstanding frame is made of metal.

7. A case as recited in claim 6 further comprising: a metal ring attached to the inside bottom of said box and welded to each of said upstanding frames to provide a metal reinforced case.

8. A case as recited in claim 6 wherein said opposed side walls said opposed end walls and said slotted bottom are made of molded plastic.

9. A case as recited in claim 1 wherein said upstanding frames have an upside-down U-shaped configuration with each end of each frame being joined with the case and wherein the upper flat portion of each frame forms a handle for carrying the cases individually.

10. A case as recited in claim 1 wherein said end walls are vertically shorter and horizontally longer than said side walls.

11. A case as in claim 1 wherein said channel is located inwardly of said corresponding slot.

12. A case capable of being stacked or nested with cases of similar construction comprising:

a pair of opposed side walls;

a pair of opposed end walls integrally joined at their longitudinal edges with said side walls;

a bottom joined to the bottom of each of said side walls and said end walls to define a box with an open top;

an upstanding frame extending upwardly from each said side wall, said frame having an upper portion;

an elongated channel formed in the underside of said bottom adjacent each said side wall, said channel being in registry with the upper portion of said frame;

an elongated slot formed adjacent each said elongated channel and parallel thereto, said slot extending completely through said bottom and having a length and width sufficient to permit passage of the frames of two lower oriented cases;

wherein said case is adapted to be stacked upon a lower oriented case by receiving the upper portion of each of the upstanding frames of the lower case in said corresponding channel and wherein said case is adapted to be nested by receiving one of the upstanding frames from each of two lower oriented cases in one of said slots.

13. A case as in claim 12 wherein the height of the upstanding frame is slightly greater than the height of two side walls, so that at least two cases in a nested group are arranged in the same manner as two stacked cases.

14. A case as in claim 12 wherein, in a nested configuration, one upstanding frame of each case passes through a slot in an above oriented case and the other upstanding frame of each case passes along the outside of a side wall of an above oriented case.

15. A case as in claim 13 wherein said two cases are not adjacent cases.

16. A case capable of being stacked or nested with cases of similar construction comprising:

a pair of opposed side walls;

a pair of opposed end walls integrally joined at their longitudinal edges with said side walls;

a bottom joined to the bottom of said side walls and said end walls to define a box with an open top;

an upstanding frame extending upwardly from each said side wall;

an elongated slot extending completely through said bottom, said slot being adjacent and substantially parallel to one of said side walls, said slot having a length and width adapted to receive one of the upstanding frames from two lower oriented cases, with the other upstanding frames passing along the outside of the other of said side wall.

* * * * *